US011655605B2

(12) United States Patent
Zong et al.

(10) Patent No.: US 11,655,605 B2
(45) Date of Patent: May 23, 2023

(54) FRP COMPOSITE MATERIAL PILE PREPARED BY FRP COMPOSITE MATERIAL AND PREPARATION AND PILE FORMING METHODS

(71) Applicant: Jiangsu Ocean University, Lianyungang (CN)

(72) Inventors: Zhongling Zong, Lianyungang (CN); Kui Zhang, Lianyungang (CN); Haiyong Song, Lianyungang (CN); Qinghai Xie, Lianyungang (CN); Jianguo Zhu, Lianyungang (CN); Mingzhi Song, Lianyungang (CN); Liwei Zhu, Lianyungang (CN); Zhiyi Lu, Lianyungang (CN)

(73) Assignee: Jiangsu Ocean University, Lianyungang (CN)

( * ) Notice: Subject to any disclaimer, the term of this patent is extended or adjusted under 35 U.S.C. 154(b) by 0 days.

(21) Appl. No.: 17/352,254

(22) Filed: Jun. 19, 2021

(65) Prior Publication Data

US 2022/0098814 A1 Mar. 31, 2022

(30) Foreign Application Priority Data

Sep. 26, 2020 (CN) ..... 202011027852.1

(51) Int. Cl.

| | |
|---|---|
| ***E02D 5/52*** | (2006.01) |
| ***E02D 5/30*** | (2006.01) |
| ***E04C 5/07*** | (2006.01) |

(52) U.S. Cl.

CPC ..... *E02D 5/30* (2013.01); *E02D 5/526* (2013.01); *E04C 5/073* (2013.01);

(Continued)

(58) Field of Classification Search

CPC .. E02D 5/30; E02D 5/38; E02D 5/526; E02D 2300/0054

(Continued)

(56) References Cited

U.S. PATENT DOCUMENTS 3,650,553 A * 3/1972 Wennstrom ..... E02D 5/523 403/294
4,009,550 A * 3/1977 Young ..... E04B 1/215 405/251

(Continued)

FOREIGN PATENT DOCUMENTS

CN 105386437 A * 3/2016
CN 107905215 A * 4/2018

(Continued)

*Primary Examiner* — Frederick L Lagman
(74) *Attorney, Agent, or Firm* — Offit Kurman, P.A.; Chintan A. Desai

(57) ABSTRACT

The present disclosure discloses a fiber reinforce plastic (FRP) composite material pile prepared by an FRP composite material. The FRP composite material pile includes: an FRP winding pipe, an FRP pultrusion hollow profile, and a connecting device. The FRP pultrusion hollow profile includes an outer ring pipe, an inner ring pipe, and a plurality of reinforcing bars. The FRP pultrusion hollow profile is pultruded at one time by pultrusion equipment, and fiber materials thereof are arranged in the longitudinal direction of the pipe. The FRP winding pipe is provided with circumferential fiber materials by taking the FRP pultrusion hollow profile as a membrane, and forms a composite pipe section with the FRP pultrusion hollow profile. The inner ring shape of the cross section of the FRP winding pipe is matched with the FRP pultrusion hollow profile. The FRP connecting device includes connecting plates, connecting bars, and connecting pins.

20 Claims, 5 Drawing Sheets

(52) U.S. Cl.
CPC ..... *E02D 2200/1685* (2013.01); *E02D 2250/0023* (2013.01); *E02D 2300/002* (2013.01); *E02D 2300/0034* (2013.01); *E02D 2300/0051* (2013.01); *E02D 2600/20* (2013.01)

(58) Field of Classification Search
USPC ..... 405/251, 252
See application file for complete search history.

(56) References Cited

U.S. PATENT DOCUMENTS 4,836,717 A * 6/1989 Landaeus ..... E02D 5/523 403/294
5,599,599 A * 2/1997 Mirmiran ..... E04C 5/07 428/36.3
6,123,485 A * 9/2000 Mirmiran ..... E04C 3/29 405/232
11,319,689 B1 * 5/2022 Mehrabi ..... E02D 5/526
2014/0241816 A1 * 8/2014 Koivunen ..... E02D 5/30 405/252

FOREIGN PATENT DOCUMENTS

CN 108118692 A * 6/2018
CN 109056708 A * 12/2018 ..... E02D 27/52
CN 110700274 A * 1/2020
CN 110714461 A * 1/2020
CN 112211190 A * 1/2021
KR 200382590 Y1 * 5/2005 ..... E02D 27/52
KR 101193075 B1 * 10/2012
KR 101252027 B1 * 4/2013
KR 101376497 B1 * 3/2014
KR 20180106282 A * 10/2018
KR 20220105053 A * 7/2022

* cited by examiner

FRP COMPOSITE MATERIAL PILE PREPARED BY FRP COMPOSITE MATERIAL AND PREPARATION AND PILE FORMING METHODS

CROSS-REFERENCE TO RELATED APPLICATIONS

This application is a United States patent application filing under 35 U.S.C. 119(a) that claims the benefit of Chinese patent application no. CN20201127852, filed Sep. 26, 2020, which is hereby incorporated by reference as if fully set forth herein, for all purposes.

TECHNICAL FIELD

The present disclosure relates to the technical field of civil water conservancy and marine engineering structural piles, and in particular, to a fiber reinforce plastic (FRP) composite material pile prepared by an FRP composite material. The present disclosure further relates to preparation and pile forming methods for the FRP composite material pile prepared by the FRP composite material, which can be used for pile foundations in civil water conservancy and marine engineering structures.

BACKGROUND

Pile foundations are widely used in engineering. There are many types of pile foundations, which can be divided into concrete piles, steel piles, and composite material piles according to the materials of pile bodies. Reinforced concrete piles are the mostly widely used pile foundations at present. They have the advantages of convenience in manufacturing, high pile body strength, low cost, and the like, and can be divided into precast concrete square piles, prestressed concrete hollow pipe piles, cast-in-place concrete piles, and the like. A steel pile consists of a steel pipe pile and a section steel pile. The strength of the material of a pile body is high. The pile body has large surface area and small cross-sectional area, and has strong penetration ability and low soil compacting influence in a pile sinking process. The influence on adjacent buildings in a saturated soft clay area can be reduced. The steel piles have high price and poor corrosion resistance, so the application of the steel piles is limited to a certain extent.

In coastal and other high saline areas, there are many chloride ions and other salts in foundation soil, and the steel piles and the reinforced concrete piles are corroded very easily. The bearing capacity of the corroded steel piles and the reinforced concrete piles is significantly reduced, so the engineering safety risk is great.

With continuous emergence of new materials, the combination of high-performance materials and traditional materials is creatively applied in foundation engineering.

SUMMARY

The technical problem to be solved by the present disclosure is to provide an FRP composite material pile prepared by an FRP composite material with respect to the defects in the prior art. The FRP composite material pile can be spliced into an assembled composite pile through plug-in components in a construction site by directly using factory made FRP profiles. The assembly is convenient and fast.

Another technical problem to be solved by the present disclosure is to provide a preparation method for the FRP composite material pile.

Yet another technical problem to be solved by the present disclosure is to provide a pile forming method for the FRP composite material pile.

The technical problems of the present disclosure are solved by the following technical solution. The present disclosure discloses an FRP composite material pile prepared by an FRP composite material. The FRP composite material pile includes: an FRP winding pipe, an FRP pultrusion hollow profile, and a connecting device;

the FRP pultrusion hollow profile includes an outer ring pipe, an inner ring pipe, and a plurality of reinforcing bars for connecting the outer ring pipe and the inner ring pipe; the shape of the cross section of the outer ring pipe is a circle or a square with chamfers; the FRP pultrusion hollow profile is pultruded at one time by pultrusion equipment, and fiber materials thereof are arranged in the longitudinal direction of the pipe;

the FRP winding pipe is provided with circumferential fiber materials by taking the FRP pultrusion hollow profile as a membrane, and forms a composite pipe section with the FRP pultrusion hollow profile; the inner ring shape of the cross section of the FRP winding pipe is matched with the FRP pultrusion hollow profile;

the FRP connecting device includes connecting plates, connecting bars, and connecting pins; the outer ring shapes of the cross sections of the connecting plates are matched with composite pipe sections; the connecting bars are inserted into the connecting plates; key grooves matched with the connecting pins and used for connecting are also formed in the connecting plates; the connecting pins are used for connecting two connecting plates through the key grooves, so that the connection of two composite pipe sections is realized; a plurality of the composite pipe sections are connected to form the FRP composite material pile.

A further preferred technical solution of the FRP composite material pile prepared by an FRP composite material of the present disclosure is that: the reinforcing bars between the outer ring pipe and the inner ring pipe are arranged in circumferential symmetry; the space between an inner pipe and an outer pipe is divided into a plurality of cavities by the reinforcing bars; a cavity is also formed in the inner pipe; the cavities are used for filling a cement-based material during pile forming.

A further preferred technical solution of the FRP composite material pile prepared by an FRP composite material of the present disclosure is that: the connecting bars arranged on the connecting plates are arranged in circumferential symmetry; the key grooves are also formed in circumferential symmetry.

A further preferred technical solution of the FRP composite material pile prepared by an FRP composite material of the present disclosure is that: the connecting bars are reinforcing steel bars or FRP bars.

A further preferred technical solution of the FRP composite material pile prepared by an FRP composite material of the present disclosure is that: the connecting pins are I-shaped, Z-shaped or frame-shaped, or can also be other applicable shapes.

A further preferred technical solution of the FRP composite material pile prepared by an FRP composite material of the present disclosure is that: the connecting bars are also arranged symmetrically.

A further preferred technical solution of the FRP composite material pile prepared by an FRP composite material of the present disclosure is that: the thickness of the connecting plate is 30 mm to 60 mm, preferably, 40 mm to 50 mm; the length of the connecting bar is 30 to 40 times the diameter of the reinforcing steel bar, preferably, 34 mm to 36 mm.

The present disclosure further discloses a preparation method for the FRP composite material pile, including the following steps:

(1) processing and manufacturing connecting plates, connecting pins, and connecting bars of an FRP connecting device, and processing connecting key grooves matched with the connecting pins;

(2) preparing an FRP pultrusion hollow profile by pultrusion equipment, wherein the length of the pipe is 3 m to 5 m;

(3) manufacturing a circumferential FRP winding pipe by taking the FRP pultrusion hollow profile as a membrane to obtain a composite pipe section;

(4) connecting the connecting plate of the FRP connecting device to one end of the composite pipe section, and performing sealing treatment;

(5) connecting the connecting plates of the FRP connecting device by using the connecting pins to realize the connection of two composite pipe sections until the composite pipe sections in the number required by a design are connected to form the FRP composite material pile.

The present disclosure further discloses a pile forming method for the FRP composite material pile prepared by the FRP composite material, including the following steps:

(1) after connecting a connecting plate to a composite pipe section, pouring cement-based filler in the cavities of the composite pipe section, where the strength of the filler is not less than 30 MPa, layered pouring is adopted during pouring, and vibrating is performed while pouring, so that the filler is compact;

(2) after the pouring of one composite pipe section is completed, inserting the connecting bars of the FRP connecting device into the filler in top cavities to form a whole body, and curing to complete the pouring of one composite pipe section;

(3) connecting, by using the connecting pins, the poured composite pipe section to a composite pipe section to be poured, and operating according to the foregoing method, continuing performing pouring of the composite pipe sections until completing the pile forming of the overall FRP composite material pile.

Compared with the prior art, the present disclosure has the following beneficial effects:

1. The coefficient of thermal expansion of the FRP composite material is similar to that of a cement-based material, so when the ambient temperature changes, FRP and concrete work cooperatively, and there is no great temperature stress between them; the FRP composite material has good designability, and the shape of the pultrusion cross section of the pile body is flexible.

2. The present disclosure fully utilizes the characteristics of light weight, high strength, good sealing property, and good corrosion resistance of the FRP composite material; after pile forming, the corrosion resistance is strong, the application range is wide, and the pile can be used in a strong corrosive environment.

3. The present disclosure can make use of factory production to realize on-site assembly, which is beneficial to ensuring the engineering quality and improving labor the efficiency, and the industrialization degree of production and construction is high; the FRP pultrusion profile is directly used as an FRP winding pipe membrane, which saves a pipe demoulding process and has obvious economic benefits.

4. The FRP winding pipe of the present disclosure has circumferential fiber materials, and the FRP pultrusion profile has vertical fiber materials, which can provide the cement-based filler filled in the cavities with multi-directional effective constraint; the filling of the cement-based filler also provides stable support for the FRP pultrusion profile; on the whole, the mechanical performance is excellent.

5. The connecting device of the present disclosure is provided with the connecting bars, so the connecting quality is good; the overall rigidity is high; the connecting device is provided with the key grooves, which are connected through the connecting pins, so the connection and installation are simple and reliable.

DETAILED DESCRIPTION OF ILLUSTRATIVE EMBODIMENTS

The specific technical solution of the present disclosure is further described below, which facilitates further understanding of the present disclosure by those skilled in the art, and does not constitute a restriction on its rights.

Figure 8:
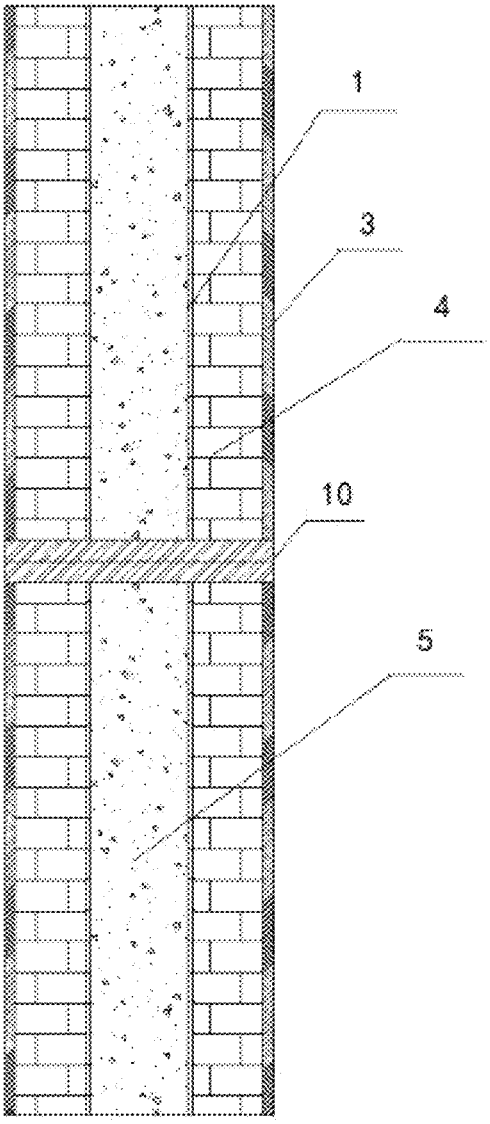
FIG. 8 is a schematic structural diagram of the FRP composite material pile.

Embodiment 1, referring to FIG. 8, an FRP composite material pile prepared by an FRP composite material includes: an FRP winding pipe 1, an FRP pultrusion hollow profile, and a connecting device 10.

Figure 1:
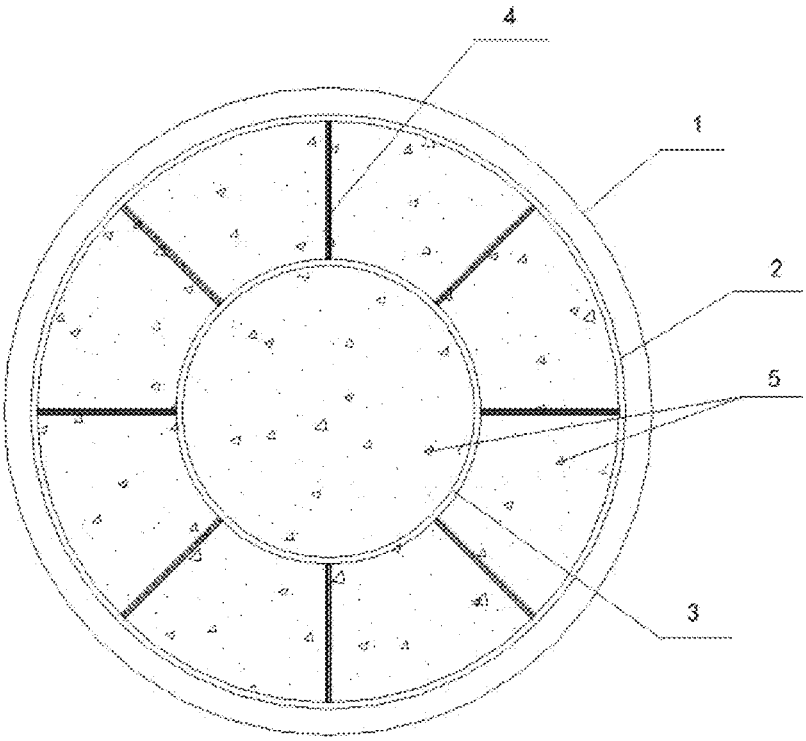
FIG. 1 is a schematic diagram of a cross section structure of an FRP composite material pile of the present disclosure.
Figure 2:
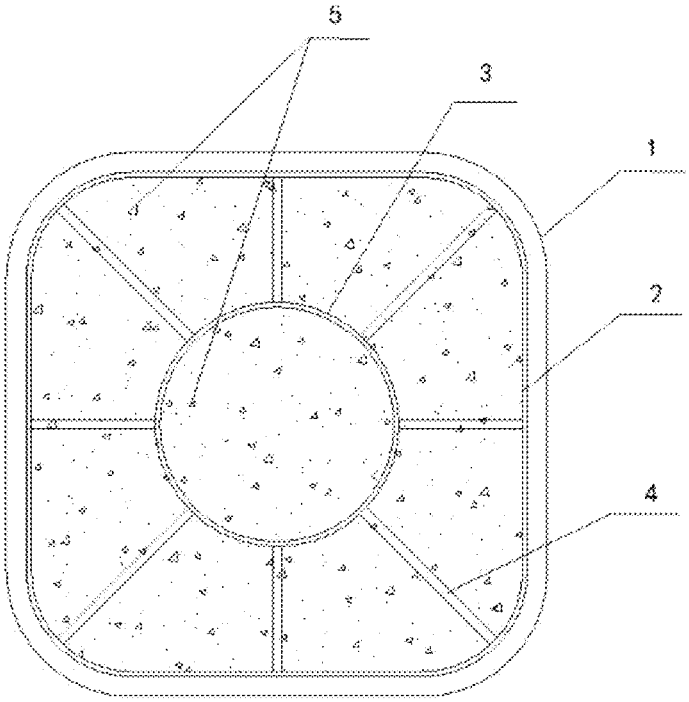
FIG. 2 is a schematic diagram of another cross section structure of the FRP composite material pile of the present disclosure.

Referring to FIG. 1, the FRP pultrusion hollow profile includes an outer ring pipe 2, an inner ring pipe 3, and a plurality of reinforcing bars 4 for connecting the outer ring pipe 2 and the inner ring pipe 3. Referring to FIG. 2, the shape of the cross section of the outer ring pipe 2 is a circle or the shape of the cross section of the outer ring pipe 2 is a square with chamfers. The FRP pultrusion hollow profile is pultruded at one time by pultrusion equipment, and fiber materials thereof are arranged in the longitudinal direction of the pipe.

The FRP winding pipe 1 is provided with circumferential fiber materials by taking the FRP pultrusion hollow profile as a membrane, and forms a composite pipe section with the FRP pultrusion hollow profile; the inner ring shape of the cross section of the FRP winding pipe 1 is matched with the FRP pultrusion hollow profile.

Figure 3:
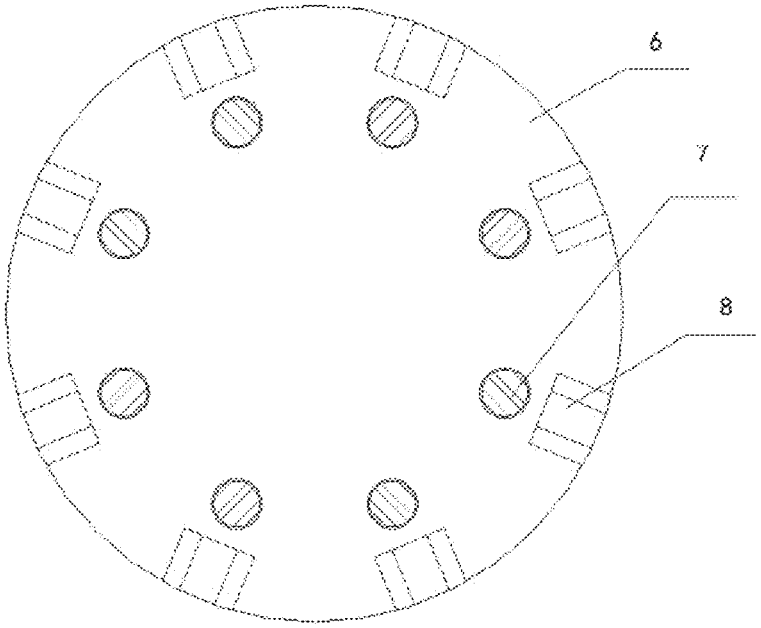
FIG. 3 is a schematic diagram of a cross section structure of an FRP connecting device.
Figure 4:
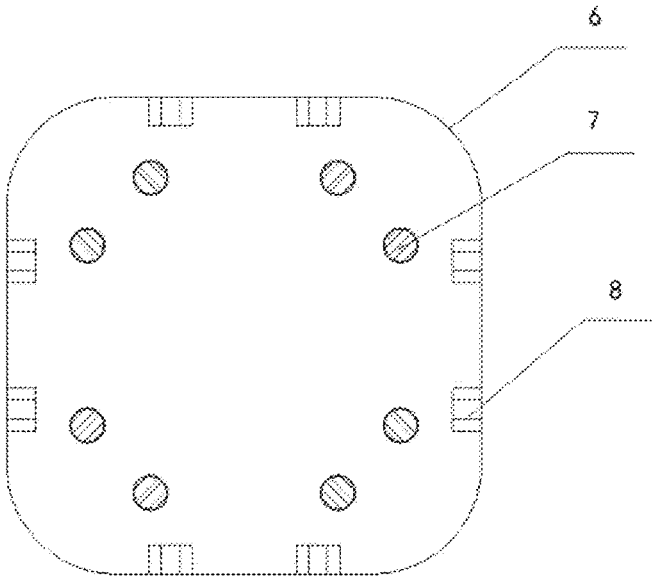
FIG. 4 is a schematic diagram of another cross section structure of the FRP connecting device.

Referring to FIGS. 3 and 4, the FRP connecting device 10 includes connecting plates 6, connecting bars 7, and key grooves 8; the outer ring shapes of the cross sections of the connecting plates 6 are matched with the composite pipe sections; the connecting bars 7 are inserted into the connecting plates 6; key grooves 8 matched with the connecting pins 9 and used for connecting are also formed in the connecting plates 6; the connecting pins 7 are used for connecting two connecting plates 6 through the key grooves 8, so that the connection of two composite pipe sections is realized; a plurality of the composite pipe sections are connected to form the FRP composite material pile.

Referring to FIGS. 1 and 2, the reinforcing bars 4 between the outer ring pipe 2 and the inner ring pipe 3 are arranged in circumferential symmetry; the space between an inner pipe and an outer pipe is divided into a plurality of cavities by the reinforcing bars 4; a cavity is also formed in the inner pipe; the cavities are used for filling a cement-based material 5 during pile forming.

Referring to FIG. 3, the connecting bars 7 arranged on the connecting plates 6 are preferably arranged in circumferential symmetry. The key grooves 8 are also formed in circumferential symmetry. The connecting bars 7 are reinforcing bars or FRP bars. The connecting reinforcing bars 7 are also arranged symmetrically.

Figure 5:
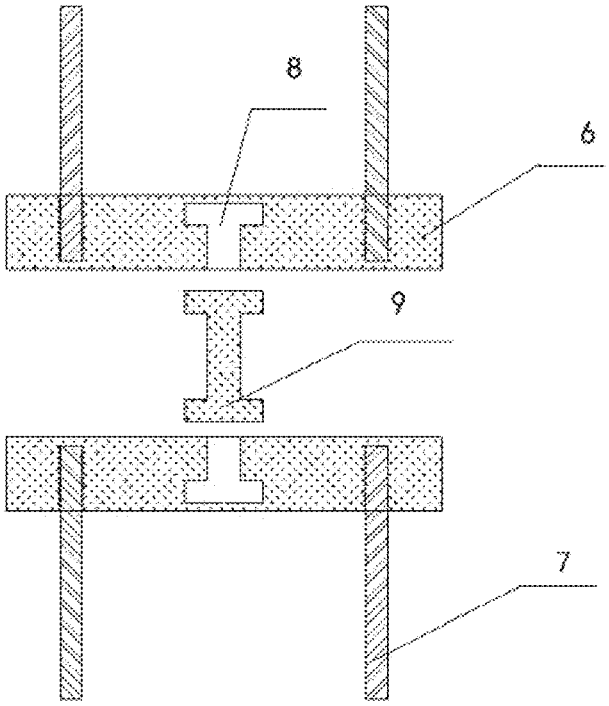
FIG. 5 to FIG. 7 are four schematic structural diagrams of the FRP connecting device when connected.
Figure 6:
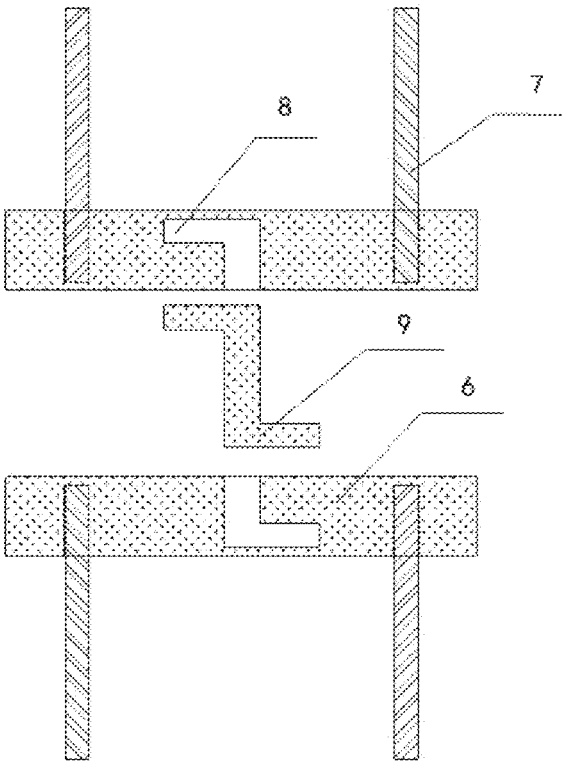
Figure 7:
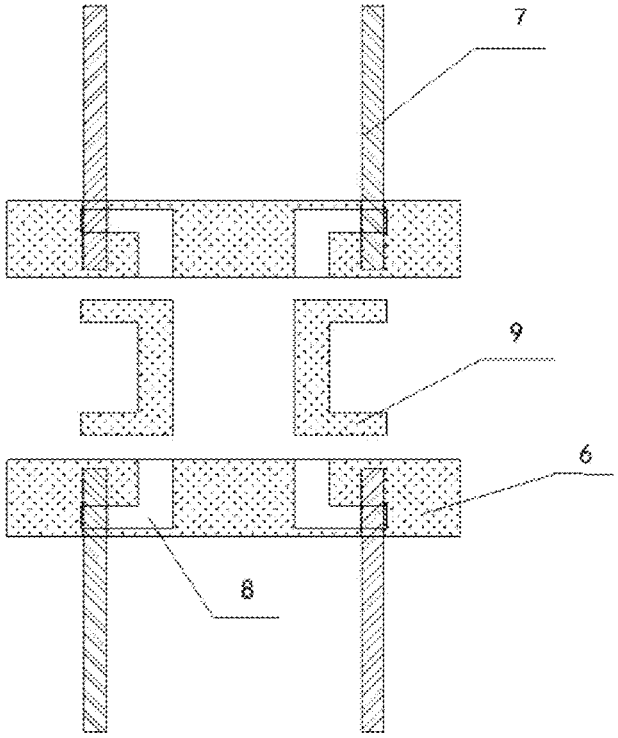

The connecting pins 9 may be I-shaped, referring to FIG. 5, may also be Z-shaped, referring to FIG. 6, and may also be frame-shaped, referring to FIG. 7.

The thickness of the connecting plate is preferably 40 mm to 50 mm; the length of the connecting bar is 35 times the diameter of the reinforcing bar.

Embodiment 2, a preparation method for the FRP composite material pile of the Embodiment 1 includes the following steps:

(1) processing and manufacturing connecting plates, connecting pins, and connecting bars of an FRP connecting device 10, and processing connecting key grooves matched with the connecting pins;

(2) preparing an FRP pultrusion hollow profile by pultrusion equipment, where the length of the pipe is 3 m to 5 m;

(3) manufacturing a circumferential FRP winding pipe by taking the FRP pultrusion hollow profile as a membrane to obtain a composite pipe section;

(4) connecting the connecting plate of the FRP connecting device 10 to one end of the composite pipe section, and performing sealing treatment;

(5) connecting the connecting plates of the FRP connecting device 10 by using the connecting pins to realize the connection of two composite pipe sections until the composite pipe sections in the number required by a design are connected to form the FRP composite material pile.

Embodiment 3, a pile forming method using the FRP composite material pile prepared in Embodiment 2 includes the following steps:

(1) after connecting the connecting plate and the composite pipe section, pouring cement-based filler in the cavities of the composite pipe section, where the strength of the filler is not less than 30 MPa, layered pouring is adopted during pouring, and vibrating is performed while pouring, so that the filler is compact;

(2) after the pouring of one composite pipe section is completed, inserting the connecting bars of the FRP connecting device 10 into the filler in top cavities to form a whole body, and curing to complete the pouring of one composite pipe section;

(3) connecting, by using the connecting pins, the poured composite pipe section to a composite pipe section to be poured, and operating according to the foregoing method, continuing performing pouring of the composite pipe sections until completing pile forming of the overall FRP composite material pile.

What is claimed:

1. An FRP (Fiber Reinforce Plastic) composite material pile prepared by an FRP composite material, comprising: an FRP winding pipe, an FRP pultrusion hollow profile, and a connecting device, wherein the FRP pultrusion hollow profile comprises an outer ring pipe, an inner ring pipe, and a plurality of reinforcing bars for connecting the outer ring pipe and the inner ring pipe; the shape of the cross section of the outer ring pipe is a circle or a square with chamfers; the FRP pultrusion hollow profile is pultruded at one time by pultrusion equipment, and fiber materials thereof are arranged in the longitudinal direction of the pipe;

the FRP winding pipe is provided with circumferential fiber materials by taking the FRP pultrusion hollow profile as a membrane, and forms a composite pipe section with the FRP pultrusion hollow profile;

the inner ring shape of the cross section of the FRP winding pipe is matched with the FRP pultrusion hollow profile;

the FRP connecting device comprises connecting plates, connecting bars, and key grooves; the outer ring shapes of the cross sections of the connecting plates are matched with composite pipe sections; the connecting bars are inserted into the connecting plates; key grooves matched with connecting pins and used for connecting are also formed in the connecting plates; the connecting pins are used for connecting two connecting plates through the key grooves, so that the connection of two composite pipe sections is realized; a plurality of the composite pipe sections are connected to form the FRP composite material pile.

2. The FRP composite material pile prepared by an FRP composite material according to claim 1, wherein the reinforcing bars between the outer ring pipe and the inner ring pipe are arranged in circumferential symmetry; the space between an inner pipe and an outer pipe is divided into a plurality of cavities by the reinforcing bars; a cavity is also formed in the inner pipe; the cavity is used for filling a cement-based material during pile forming.

3. The FRP composite material pile prepared by an FRP composite material according to claim 1, wherein connecting bars arranged on the connecting plates are arranged in circumferential symmetry; the key grooves are also formed in circumferential symmetry.

4. The FRP composite material pile prepared by an FRP composite material according to claim 1, wherein the connecting bars are reinforcing steel bars or FRP bars.

5. The FRP composite material pile prepared by an FRP composite material according to claim 3, wherein the connecting bars are reinforcing steel bars or FRP bars.

6. The FRP composite material pile prepared by an FRP composite material according to claim 1, wherein the connecting pins are I-shaped, Z-shaped or frame-shaped.

7. The FRP composite material pile prepared by an FRP composite material according to claim 1, wherein connecting bars are also arranged symmetrically.

8. The FRP composite material pile prepared by an FRP composite material according to claim 1, wherein the thickness of the connecting plates is 30 mm to 60 mm, and the length of the connecting bars is 30 to 40 times the diameter of the reinforcing steel bar.

9. A preparation method for the FRP composite material pile according to claim 1, comprising the following steps:

(1) processing and manufacturing connecting plates, connecting pins, and connecting bars of an FRP connecting device, and processing connecting key grooves matched with the connecting pins;

(2) preparing an FRP pultrusion hollow profile by pultrusion equipment, wherein the length of the pipe is 3 m to 5 m;

(3) manufacturing a circumferential FRP winding pipe by taking the FRP pultrusion hollow profile as a membrane to obtain a composite pipe section;

(4) connecting a connecting plate of the FRP connecting device to one end of the composite pipe section, and performing sealing treatment;

(5) connecting the connecting plates of the FRP connecting device by using the connecting pins to realize the connection of two composite pipe sections until the composite pipe sections in the number required by a design are connected to form the FRP composite material pile.

10. The preparation method for the FRP composite material pile according to claim 9, wherein the reinforcing bars between the outer ring pipe and the inner ring pipe are arranged in circumferential symmetry; the space between an inner pipe and an outer pipe is divided into a plurality of cavities by the reinforcing bars; a cavity is also formed in the inner pipe; the cavity is used for filling a cement-based material during pile forming.

11. The preparation method for the FRP composite material pile according to claim 9, wherein connecting bars arranged on the connecting plates are arranged in circumferential symmetry; the key grooves are also formed in circumferential symmetry.

12. The preparation method for the FRP composite material pile according to claim 9, wherein the connecting bars are reinforcing steel bars or FRP bars.

13. The preparation method for the FRP composite material pile according to claim 11, wherein the connecting bars are reinforcing steel bars or FRP bars.

14. The preparation method for the FRP composite material pile according to claim 9, wherein the connecting pins are I-shaped, Z-shaped or frame-shaped.

15. The preparation method for the FRP composite material pile according to claim 9, wherein connecting bars are also arranged symmetrically.

16. The preparation method for the FRP composite material pile according to claim 9, wherein the thickness of the connecting plates is 30 mm to 60 mm, and the length of the connecting bars is 30 to 40 times the diameter of the reinforcing steel bar.

17. A pile forming method for the FRP composite material pile prepared by the FRP composite material according to claim 1, comprising the following steps:

(1) after connecting the connecting plate and the composite pipe section, pouring cement-based filler in the cavities of the composite pipe section, wherein the strength of the filler is not less than 30 MPa, layered pouring is adopted during pouring, and vibrating is performed while pouring, so that the filler is compact;

(2) after the pouring of one composite pipe section is completed, inserting the connecting bars of the FRP connecting device into the filler in top cavities to form a whole body, and curing to complete the pouring of one composite pipe section;

(3) connecting, by using the connecting pins, the poured composite pipe section to a composite pipe section to be poured, and operating according to the foregoing method, and continuing performing pouring of the composite pipe sections until completing the pile forming of the overall FRP composite material pile.

18. The pile forming method for the FRP composite material pile prepared by the FRP composite material according to claim 17, wherein the reinforcing bars between the outer ring pipe and the inner ring pipe are arranged in circumferential symmetry; the space between an inner pipe and an outer pipe is divided into a plurality of cavities by the reinforcing bars; a cavity is also formed in the inner pipe; the cavity is used for filling a cement-based material during pile forming.

19. The pile forming method for the FRP composite material pile prepared by the FRP composite material according to claim 17, wherein connecting bars arranged on the connecting plates are arranged in circumferential symmetry; the key grooves are also formed in circumferential symmetry.

20. The pile forming method for the FRP composite material pile prepared by the FRP composite material according to claim 17, wherein the connecting bars are reinforcing steel bars or FRP bars.

* * * * *